US007537502B2

(12) United States Patent
Parten

(10) Patent No.: US 7,537,502 B2
(45) Date of Patent: May 26, 2009

(54) RETRACTABLE TOW HOOK

(76) Inventor: Keith Parten, 315 W. Ripy St., Fort Worth, TX (US) 76110

( * ) Notice: Subject to any disclaimer, the term of this patent is extended or adjusted under 35 U.S.C. 154(b) by 21 days.

(21) Appl. No.: 11/817,002

(22) PCT Filed: Sep. 8, 2005

(86) PCT No.: PCT/US2005/031773

§ 371 (c)(1),
(2), (4) Date: Aug. 23, 2007

(87) PCT Pub. No.: WO2006/091237

PCT Pub. Date: Aug. 31, 2006

(65) Prior Publication Data

US 2008/0176466 A1 Jul. 24, 2008

Related U.S. Application Data

(63) Continuation of application No. 11/064,674, filed on Feb. 23, 2005.

(51) Int. Cl.

| | |
|---|---|
| ***B63B 35/73*** | (2006.01) |
| ***B63B 35/79*** | (2006.01) |
| ***B63B 21/56*** | (2006.01) |
| ***B63B 21/58*** | (2006.01) |

(52) U.S. Cl. ..... 441/65; 441/66; 114/249; 114/253

(58) Field of Classification Search ..... 114/242, 114/249–254; 441/65–74
See application file for complete search history.

(56) References Cited

U.S. PATENT DOCUMENTS

| | | | | | |
|---|---|---|---|---|---|
| 3,380,425 | A | * | 4/1968 | Wilson | 114/253 |
| 3,626,428 | A | * | 12/1971 | Collaro | 441/65 |
| 3,803,653 | A | * | 4/1974 | Trostad | 441/72 |
| 4,028,761 | A | * | 6/1977 | Taylor | 441/65 |
| 4,619,619 | A | * | 10/1986 | Muse, Jr. | 441/65 |
| 4,756,700 | A | * | 7/1988 | Coleman | 441/65 |
| 4,883,436 | A | * | 11/1989 | Oakland | 441/65 |
| 5,009,183 | A | * | 4/1991 | Naypaver | 114/253 |
| 5,076,189 | A | * | 12/1991 | Jones | 114/253 |
| 5,083,955 | A | * | 1/1992 | Echols | 441/65 |
| 5,163,860 | A | * | 11/1992 | Clark | 441/65 |

FOREIGN PATENT DOCUMENTS

EP 0001169 A1 * 3/1979

* cited by examiner

*Primary Examiner*—Ajay Vasudeva
(74) *Attorney, Agent, or Firm*—James E. Walton

(57) ABSTRACT

An aquatic recreational device is configured for towing with a towline and has a rider-support structure for supporting a rider during travel in water. The device has a hook for releasably retaining the towline, the hook being movable between a first position, in which the hook is oriented to be substantially within the rider-support structure, and a second position, in which at least a portion of the hook is located exterior of the rider-support structure for engaging the towline.

7 Claims, 6 Drawing Sheets

RETRACTABLE TOW HOOK

This application is a Continuation of U.S. patent application Ser. No. 11/064,674, filed 23Feb. 2005.

TECHNICAL FIELD

The present invention relates to an aquatic recreational system in which a rider mounts and rides an aquatic recreational device while being towed behind a tow vehicle.

DESCRIPTION OF THE PRIOR ART

The term "aquatic recreational device" is often applied generally to devices that are designed to substantially plane along the surface of a body of water. Aquatic recreational devices include kneeboards, surfboards, skim boards, bodyboards, wakeboards, freeboards, ski boards, inflatable devices, and other appropriate devices. Aquatic recreational devices are typically towed by a tow vehicle such as a boat, jet ski, or other watercraft, but may alternatively be towed by a land vehicle, kite, sail, or even an underwater craft.

Aquatic recreational devices are typically towed by connecting one end of a towline to a tow vehicle while the other end of the towline is either connected to the aquatic recreational device directly or held by the rider of the aquatic recreational device.

Many aquatic recreational devices, such as kneeboards, require significantly difficult physical maneuvers to achieve proper riding position. For example, the rider of a typical kneeboard first lies prone on top of the kneeboard while holding onto the kneeboard with one hand and the towline with the other hand. As the kneeboard is towed through the water, the rider needs to pull himself into a kneeling position on top of the kneeboard while simultaneously holding onto the towline. Then, the rider needs to adjust a knee strap over his thighs while continuing to hold the towline. These significant adjustments to the rider's body position while attempting to accelerate the aquatic recreational device from a stopped or slowly moving state to a planing state often prove too difficult for young, weak, or otherwise inexperienced riders. If proper riding position is not achieved, the rider will typically endure significant physical strain and experience a less enjoyable ride.

Further, some aquatic recreational devices are designed to provide enjoyable riding experiences under both circumstances: with the towline attached directly to the aquatic recreational device and with the towline been held by the rider of the aquatic recreational device. The multifunctional nature of these aquatic recreational devices presents a significant problem. The problem is related to the presence of a tow hook attached to the aquatic recreational device during use by a rider who prefers not to use the tow hook. For example, a more experienced rider may prefer to perform a variety of tricks and maneuvers while planing along the surface of the water. One such maneuver is to spin 360° from an original position facing the tow vehicle to an intermediate position facing away from the tow vehicle and back to the original position. During this 360° spin maneuver, there is an increased risk that the towline held by the rider will inadvertently become snagged by or otherwise interfered with by the tow hook as the aquatic recreational device moves relative to the towline. If the towline is inadvertently snagged by the tow hook, significant difficulty may arise in completing the 360° spin maneuver. Worse yet, the towline snagged by the tow hook may cause for the rider an unfavorable dismount from the aquatic recreational device which may result in injury to the rider.

Information relevant to attempts to address these problems can be found in U.S. Pat. No. 5,427,047 issued to Woodfin et al., U.S. Pat. No. 5,163,860 issued to Clark, and U.S. Pat. No. 3,216,031 issued to Ingold. Each one of these references includes a device or feature for holding a towline, though each suffers from one or more of the following disadvantages: the device or feature presents an unnecessary risk of injury to a rider; the device or feature interferes with particular uses of the aquatic recreational device, thereby limiting the use of the aquatic recreational device; the device or feature is not easily manufactured, thereby increasing manufacturing costs associated with producing the device or feature; the device or feature occupies a large area of the aquatic recreational device, thereby limiting design options of the aquatic recreational device; implementation of design changes of the device or feature requires costly adjustments to the manufacturing process; and/or the device or feature unnecessarily reduces or eliminates clearance between the towline and the aquatic recreational device during use.

For example, the tow rope holder taught by Woodfin et al. presents a significant risk of injury to the rider because the tow rope holder is a stationary device which significantly protrudes from the riding surface of the kneeboard. It is foreseeable that a rider may be stabbed, gouged, or otherwise injured in the event of an unfavorable or accidental dismount from a kneeboard equipped with the tow rope holder taught by Woodfin et al.

Although there have been significant developments over the years in the field of aquatic recreational devices, considerable shortcomings remain. For the foregoing reasons, there is a need for an improved aquatic recreational device that allows a rider of the aquatic recreational device to safely and easily achieve proper body position on the aquatic recreational device. Further, there is a need for an improved aquatic recreational device that allows for a safe temporary connection between the aquatic recreational device and a towline.

SUMMARY OF THE INVENTION

There is a need for an improved the aquatic recreational device having a retractable tow hook.

Therefore, it is an object of the present invention to provide an aquatic recreational device having a retractable tow hook.

This object is achieved by inserting a retractable tow hook into a recess of an aquatic recreational device. In the preferred embodiment, the tow hook includes a rotatable hook biased to a position such that the hook is housed within the recess of the aquatic recreational device.

The present invention provides significant advantages, including: (1) aiding young, weak, or inexperienced riders in achieving proper riding body positioning on an aquatic recreational device; (2) preventing unwanted interference between a towline and a tow hook; and (3) providing a tow hook that automatically retracts when not in use, thereby preventing injury to a rider.

BRIEF DESCRIPTION OF THE DRAWINGS

For a more complete understanding of the present invention, including its features and advantages, reference is now made to the detailed description of the invention taken in conjunction with the accompanying drawings in which like numerals identify like parts, and in which.

DESCRIPTION OF THE PREFERRED EMBODIMENT

It should be appreciated that the following terms and phrases are intended to have a particular meaning throughout the following detailed description: "Aquatic recreational device" is intended to refer to a group of recreational water boards and other devices including but not limited to kneeboards, surfboards, skim boards, bodyboards, wakeboards, freeboards, ski boards, and inflatable devices. "Tow vehicle" is intended to refer to a group of devices capable of towing an aquatic recreational device, including but not limited to boats, jet skis, land vehicles, kites, sails, land vehicles, and underwater craft. "Towline" is intended to refer to a device used to connect a tow vehicle to an aquatic recreational vehicle, such that the towline may be flexible, such as a rope or cable, or rigid, such as a towing bar. "Planing" is intended to refer the mode of movement of an aquatic recreational device where the aquatic recreational device skims substantially along the surface of a body of water. "Plowing" is intended to refer to the mode of movement of an aquatic recreational device where the aquatic recreational device is dragged through a body of water with a substantial amount of resistance as a result of a portion of the aquatic recreational device being below the surface of the body of water. It should be appreciated that some aquatic recreational devices may serve non-recreational purposes, such as rescue aids or transportation aids.

The present invention represents the discovery that integrating a retractable tow hook with an aquatic recreational device increases the likelihood that a young, weak, or otherwise inexperienced rider of the aquatic recreational device will achieve proper body positioning on the aquatic recreational device. The present invention also represents the discovery that integrating a retractable tow hook with an aquatic recreational device decreases the likelihood of the tow hook inadvertently interfering with popular uses of the aquatic recreational device, namely, performing tricks and other maneuvers. Further, the present invention represents the discovery that integrating a retractable tow hook with an aquatic recreational device minimizes the chance that a rider will be injured by making undesirable physical contact with any portion of the tow hook.

Figure 1:
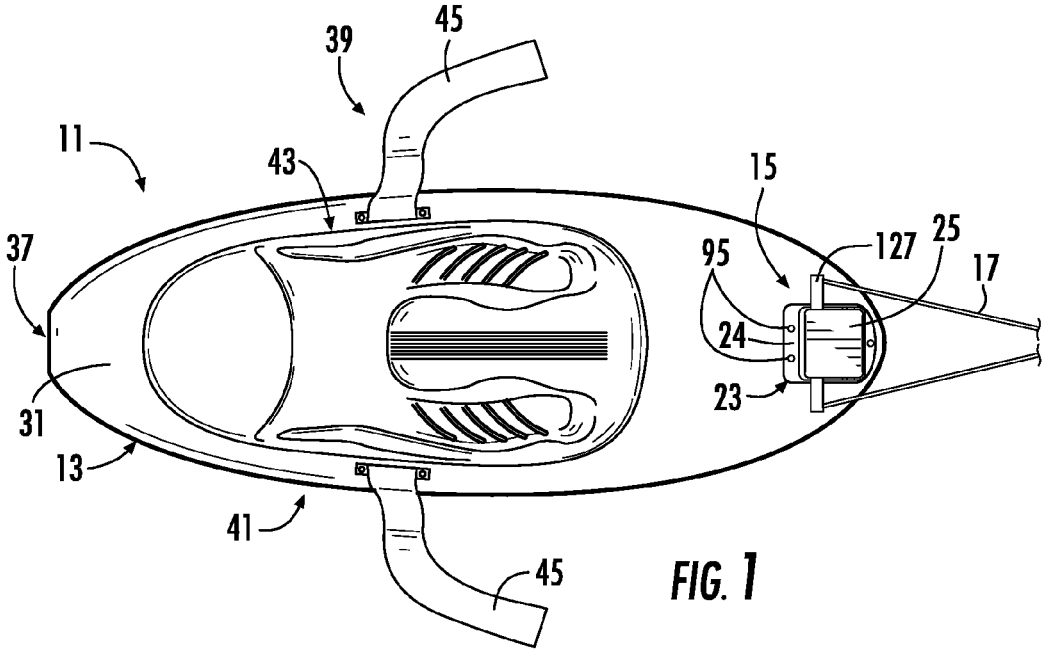
FIG. 1 is a top view of the preferred embodiment of an aquatic recreational system according to the present invention.
Figure 2:
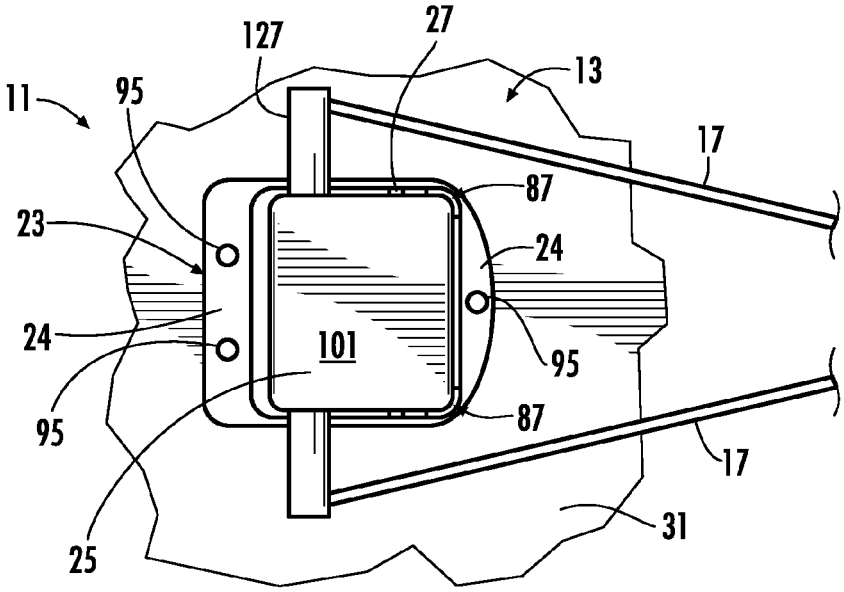
FIG. 2 is a partial top view of the aquatic recreational system of FIG. 1.
Figure 3:
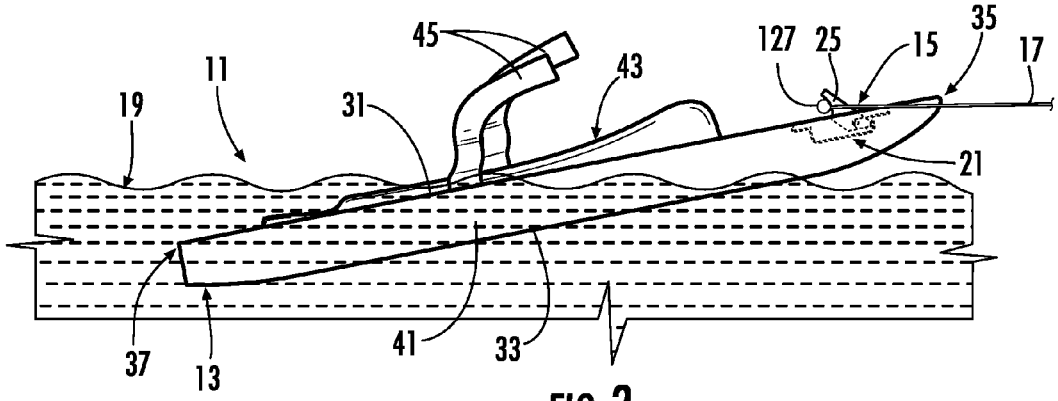
FIG. 3 is a side view of the aquatic recreational system of FIG. 1.
Figure 4:
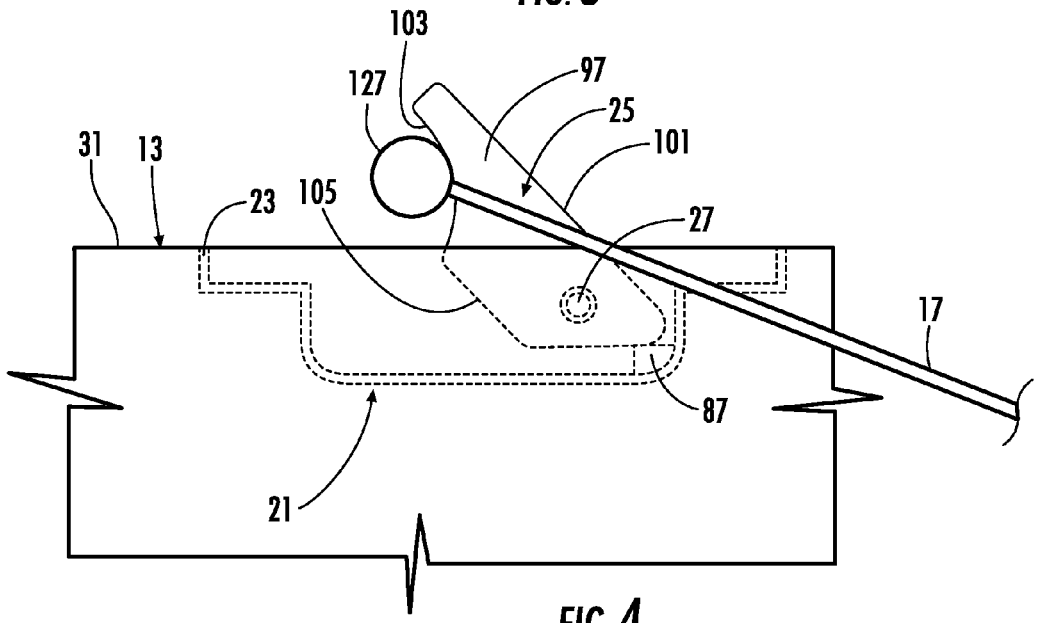
FIG. 4 is a partial side schematic view of the aquatic recreational system of FIG. 1.

Referring now to FIGS. 1 and 2 in the drawings, top views of the preferred embodiment of an aquatic recreational system 11 according to the present invention are illustrated. Also, referring to FIGS. 3 and 4 in the drawings, side views of the preferred embodiment of aquatic recreational system 11 according to the present invention are illustrated. Aquatic recreational system 11 comprises an aquatic recreational device, such as kneeboard 13, and a retractable tow hook assembly 15. Kneeboard 13 is preferably a typical kneeboard for aquatic recreation. Assembly 15 is preferably substantially shaped as a rectangular box with attached mounting lips, though assembly 15 may be formed to have other appropriate shapes. Assembly 15 is adapted to releasably retain a towline 17 as kneeboard 13 is towed through or along the surface of a body of water 19 Kneeboard 13 comprises a void or receptacle 21 adapted for receiving assembly 15, such that assembly 15 is carried by kneeboard 13 substantially within receptacle 21.

In the embodiment shown, assembly 15 comprises a housing 23 and a hook 25 rotatably attached to housing 23 with a rod 27. Housing 23 is shown as a hollow substantially rectangular box with an open top and attached mounting lips 24. Hook 25 is rotatable relative to housing 25 between at least a first position and a second position. It should be appreciated that the overall dimensions of assembly 15 may alternatively be larger or smaller while remaining within the scope of the present invention.

Figure 5:
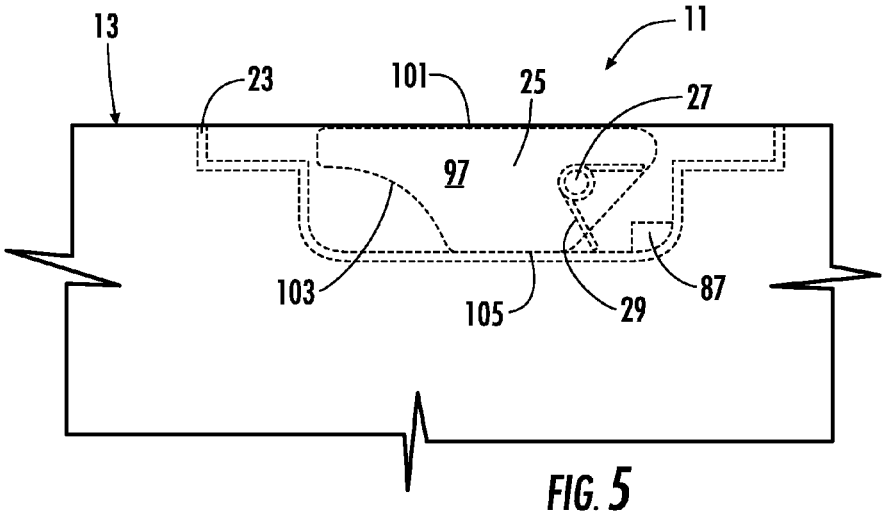
FIG. 5 is partial side schematic view of the aquatic recreational system of FIG. 1.

Referring now to FIG. 5 in the drawings, a partial side view of the aquatic recreational system 11 according to the present invention shows hook 25 in the first position, which is a retracted position. Hook 25 is preferably biased by a spring 29 toward the first position, where hook 25 is substantially stored within housing 23. Hook 25 is preferably stored within housing 23, in the first position, when assembly 15 is not being used to releasably retain towline 17. As illustrated in FIGS. 1-4, hook 25 may be rotated about rod 27 to the second position, a position where at least a portion of hook 25 protrudes from housing 23 to configure assembly 15 for releasably retaining towline 17.

Kneeboard 13 may be constructed in a number of ways which are all well known in the kneeboard industry, including but not limited to: plastic rotational molding, foam and fiberglass fabrication, and vacuum forming. Assembly 15, as described below, comprises a number of components, each with a variety of possible methods of construction.

Figure 6:
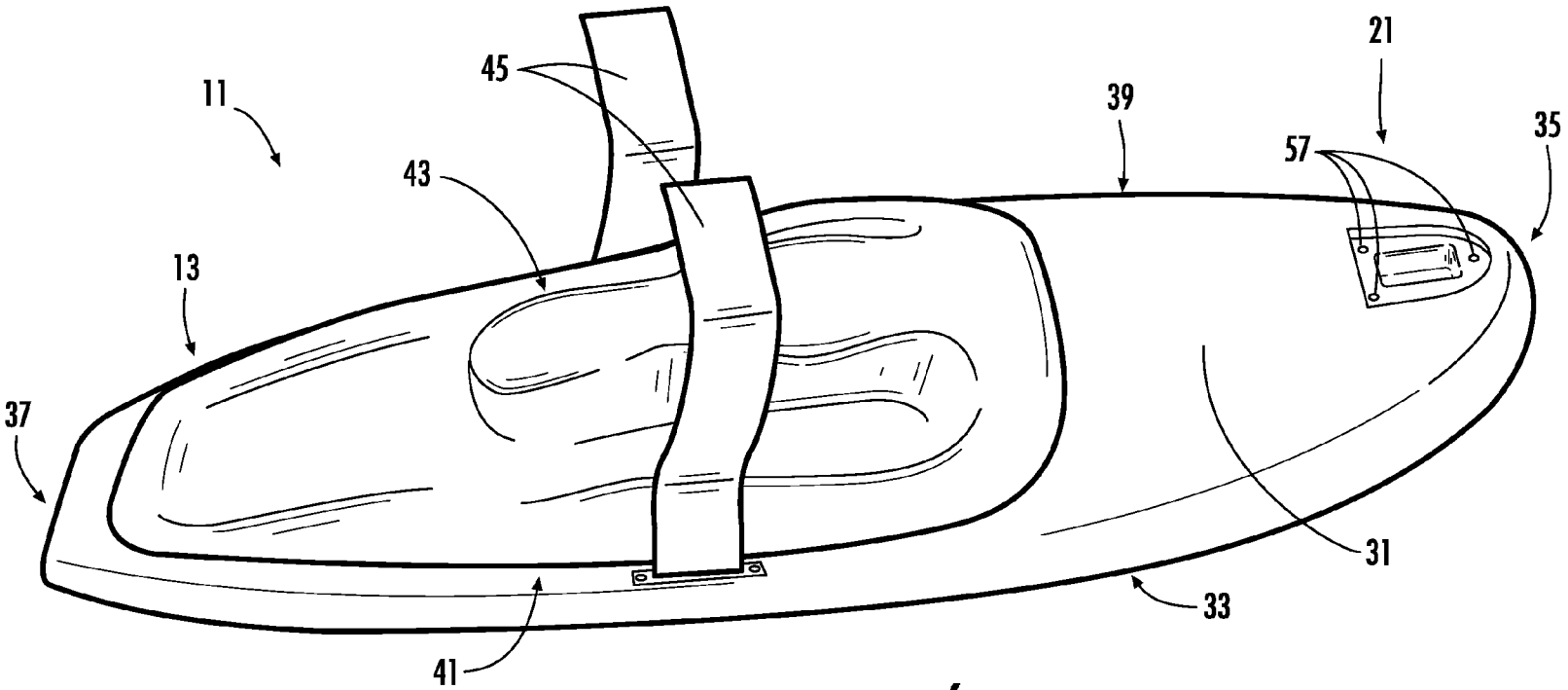
FIG. 6 is a perspective view of the kneeboard of the aquatic recreational system of FIG. 1.
Figure 7:
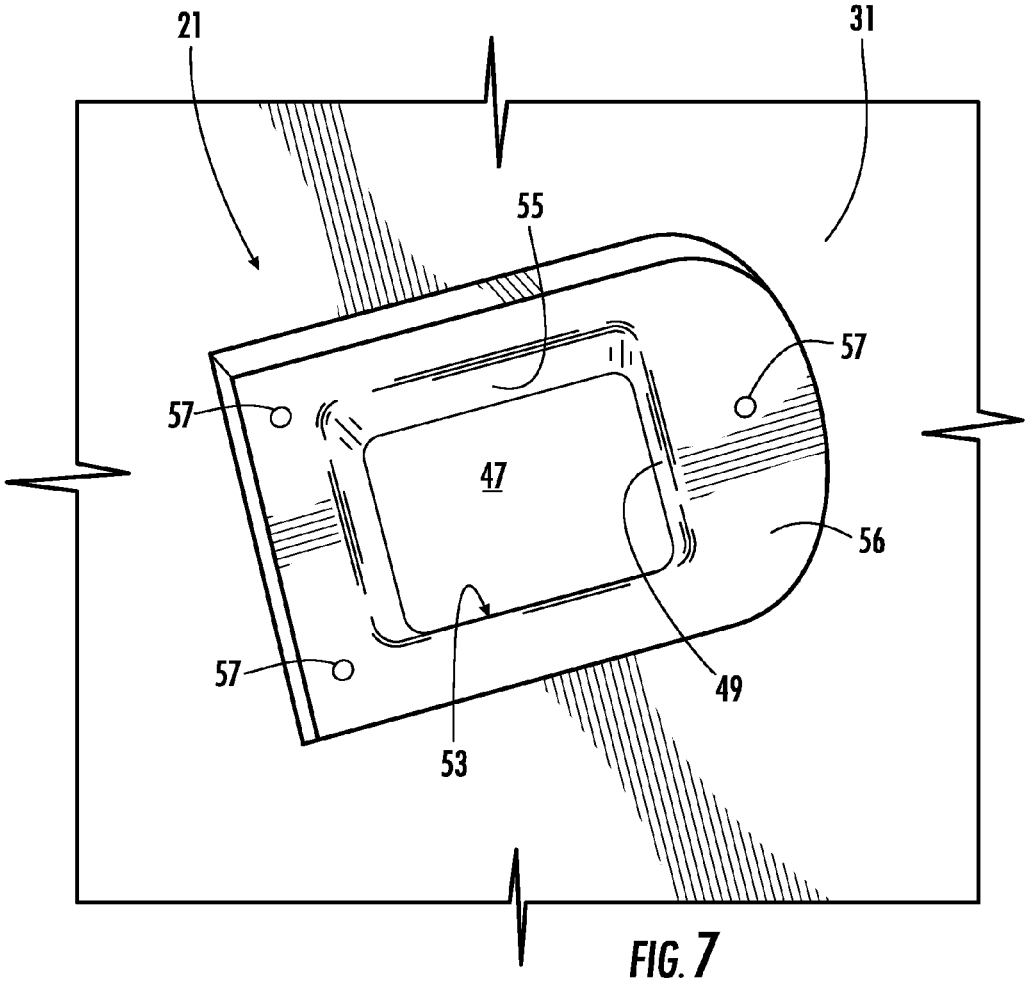
FIG. 7 is a partial perspective view of the receptacle of the aquatic recreational system of FIG. 6.

Referring now to FIG. 6 in the drawings, a perspective view of kneeboard 13 according to the present invention is illustrated. Kneeboard 13 preferably comprises a riding surface 31, a planing surface 33, a front end 35, a rear end 37, a left side 39, and a right side 41. It should be appreciated that while kneeboard 13 is illustrated as having a particular shape with a substantially pointed front end 35 and a blunt rear end 37, alternative embodiments of kneeboards 13 may have altogether different shapes. For example, kneeboard 13 may alternatively be substantially rectangular in shape, resulting in improved performance while kneeboard 13 is planing with rear end 37 of kneeboard 13 toward the tow vehicle. Further, kneeboard 13 may be shaped substantially as any other geometric shape, irregular shape, or other suitable shape.

As shown, the thickness of kneeboard 13 from riding surface 31 to planing surface 33 is substantially a constant thickness along the entire length of kneeboard 13 from front end 35 to rear end 37; however, in alternative embodiments of kneeboard 13, the thickness of kneeboard 13 may vary substantially from front end 35 to rear end 37 of kneeboard 13. Similarly, the thickness of kneeboard 13 from riding surface 31 to planing surface 33 is shown as being substantially a constant thickness along the entire width of kneeboard 13 from left side 39 to right side 41; however, in alternative embodiments, the thickness of the kneeboard may vary substantially from left side 39 to right side 41 of kneeboard 13.

Kneeboard 13 comprises a leg position feature 43 and straps 45. Leg position feature 43 is adapted to receive the knees, shins, and/or feet of a rider when the rider enters a proper kneeling position on riding surface 31. Leg position feature 43 is preferably a foam molding attached to riding surface 31; however, leg position feature 43 may alternatively be constructed of any other suitable material such as rubber or neoprene. Further, leg position feature 43 may alternatively be integral to the construction of kneeboard 13 or otherwise constructed for cooperation with riding surface 31. For example, leg position feature 43 may be an ergonomic indentation molded into riding surface 31.

Straps 45 are preferably adapted to releasably secure the rider to riding surface 31. Straps 45 are preferably adapted for use such that the rider places straps 45 over the rider's thighs as the rider achieves a kneeling position on riding surface 31. Straps 45 are preferably permanently attached to riding surface 31 at one end of each strap 45 with the remaining end of each strap free from connection to any surface of kneeboard 13. Kneeboard 13 preferably comprises two straps 45 adapted for releasable interconnection with each other through the use of hook-and-loop type fastening materials. More specifically, the hook-type material is preferably permanently affixed to one strap 45 and the loop type material is preferably permanently affixed to the other strap 45; however, straps 45 may be releasably joined through the use of buckles, knots, or other suitable devices or means of releasably connecting the two straps 45. While the preferred embodiment of kneeboard 13 comprises two straps 45 adapted for releasable attachment to each other, alternative embodiments of kneeboard 13 may comprise a single strap 45 or more than two straps 45. Further, alternative embodiments of kneeboard 13 may comprise a type of rigid bar, semi-rigid bar, or other suitable device to achieve the same results accomplished by straps 45.

Receptacle 21 is preferably a cutout void centrally located between left side 39 and right side 41. Receptacle 21 is preferably a feature cut out of riding surface 31 of kneeboard 13 and located near front end 35. Receptacle 21 preferably has a depth less than the thickness of kneeboard 13 and therefore does not span fully from riding surface 31 to planing surface 33; however, alternative embodiments of kneeboard 13 may comprise a receptacle which spans fully from riding surface 31 to planing surface 33 and would therefore present a through hole between riding surface 31 and planing surface 33. Receptacle 21 is preferably integrally lined or coated with the same hard material which forms riding surface 31; however, receptacle 21 may otherwise be coated, reinforced, or formed in any other suitable manner.

Receptacle 21 preferably comprises a receptacle bottom 47, a receptacle front face 49, a receptacle rear face 51, a receptacle right face 53, a receptacle left face 55, and a mounting face 56. As shown, mounting face 56 preferably comprises mounting holes 57; however, each of receptacle bottom 47 and faces 49, 51, 53, 55 may optionally comprise mounting holes 57 adapted for receiving fasteners (not shown), which are preferably screw-type fasteners. Mounting holes 57 preferably extend in a direction normal to the corresponding surface, and may be created by drilling into kneeboard 13. Mounting holes 57 are preferably deep enough to receive fasteners but not so deep as to create a through hole from the face being drilled into to the exterior of kneeboard 13.

Mounting holes 57 preferably carry threaded anchoring devices (not shown) that are adapted for receiving screw-type fasteners while also maintaining the structural integrity of mounting holes 57. The anchoring devices are preferably threaded metal nuts molded into kneeboard 13; however, the anchoring device may alternatively be an expanding anchoring device (similar to a drywall anchoring device) or any other suitable device. As shown, two mounting holes 57 are located near the rear of mounting face 56 while one mounting hole 57 is located near the front of mounting face 56; however; mounting holes 57 may be located at various places on each of receptacle bottom 47 and faces 49, 51, 53, 55, 56 that have mounting holes 57, and each surface may have more than one mounting hole 57. Where a surface has more than one mounting hole 57, mounting holes 57 are preferably distributed evenly or symmetrically about the surface as features of assembly 15 allow.

Figure 8:
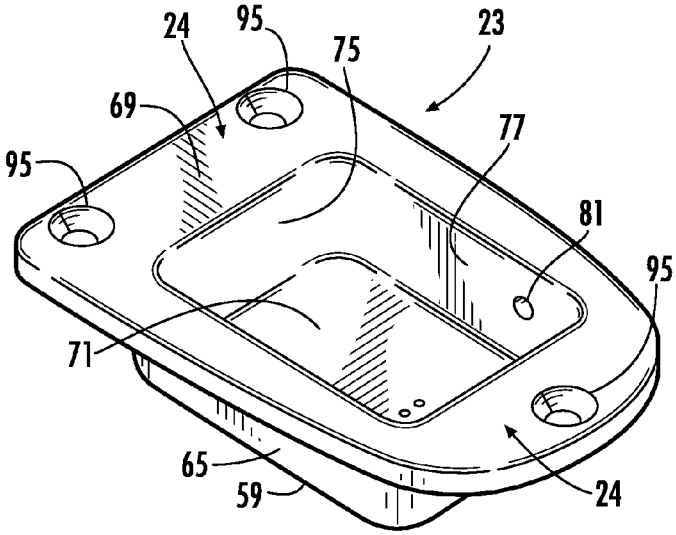
FIG. 8 is a perspective view of the housing of the aquatic recreational system of FIG. 1.
Figure 9:
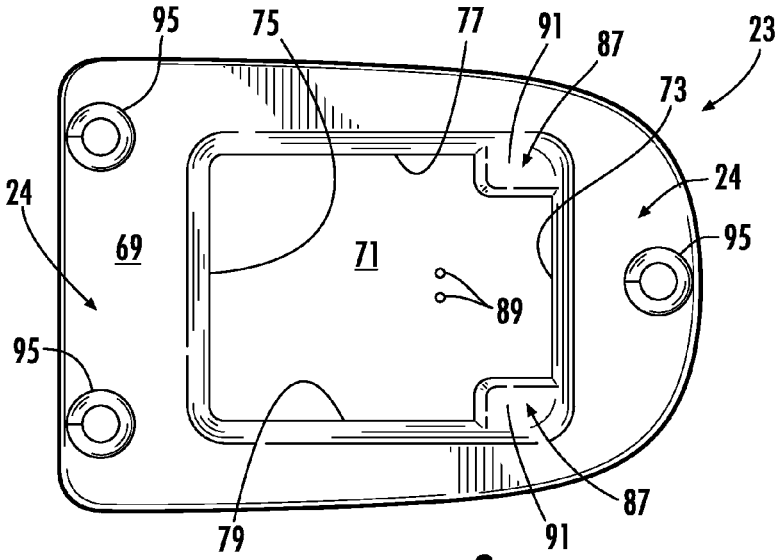
FIG. 9 is a top view of the housing of the aquatic recreational system of FIG. 1.
Figure 10:
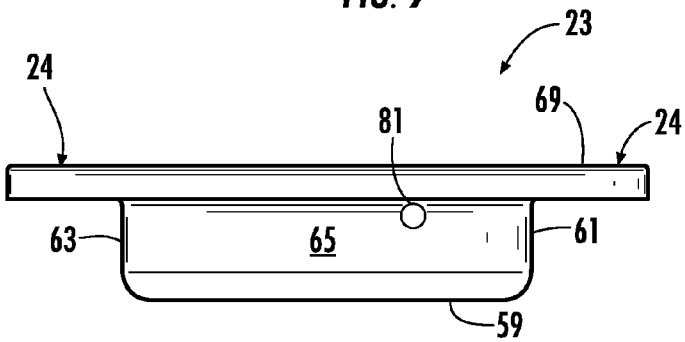
FIG. 10 is a side view of the housing of the aquatic recreational system of FIG. 1.

Referring now to FIGS. 8-10 in the drawings, a perspective, top, and side view of housing 23 according to the present invention are illustrated, respectively. Housing 23 preferably comprises a base 59, a front external face 61, a rear external face 63, a right external face 65, a left external face, and a top external face 69. Housing 23 preferably also comprises a floor 71, a front internal face 73, a rear internal face 75, a left internal face 77, and a right internal face 79. When installed in kneeboard 13, housing 23 is preferably sized and oriented such that top external face 69 is substantially flush with riding surface 31. Similarly, housing 23 is preferably sized and oriented such that base 59 substantially contacts receptacle bottom 47 when assembly 15 is installed. The preferred result of the above described sizing and orientation of housing 23 is that housing 23 is fully contained within receptacle 21. Since housing 23 is fully contained within receptacle 21, the risk that a rider may incur a physical injury due to undesirable contact with housing 23 is minimized.

Housing 23 preferably further comprises rod holes 81, which are preferably located on each of left internal face 77 and right internal face 79. Rod holes 81 are sized and shaped for receiving the ends of rod 27. Rod 27 is preferably substantially a cylindrical shaft oriented such that the axis of rod 27 is substantially parallel to floor 71, front internal face 73, and rear internal face 75. Rod holes 81 are preferably through holes. More specifically, the rod hole 81 located on left internal face 77 preferably extends fully to left external face 67. Similarly, the rod hole 81 located on right internal face 79 preferably extends fully to right external face 65. Rod 27 is preferably sized such that rod left end 83 can be oriented substantially flush with left external face 67 while rod right end 85 is substantially flush with right external face 65.

Housing 23 also preferably comprises stops 87. Stops 87 are preferably substantially a rectangular-shaped protrusion extending from front internal face 73. One stop 87 is preferably located near the apparent intersection of front internal face 73 and left internal face 77 while another stop 87 is preferably located near the apparent intersection of front internal face 73 and right internal face 79. Both stops 87 comprise a stop surface 91. Stop surfaces 91 are preferably substantially parallel to top external face 69 and are located below top external face 69. Stops 87 are preferably sized and located such that stop surfaces 91 serve to prevent further rotation of hook 25 when hook 25 has been rotated into a fully retracted position within housing 23. Stops 87 are preferably sized and located such that stop surface 91 serves to prevent further rotation of hook 25 when hook 25 has been rotated into a fully protruding position where hook 25 substantially protrudes from housing 23.

Housing preferably comprises drain holes 89 through floor 71 to allow drainage and/or evaporation of any water which may be located between housing 23 and the walls or faces of receptacle 21.

Housing 23 preferably comprises fastener holes 95 preferably adapted for receiving screw type fasteners therethrough. Fastener holes 95 are preferably located and oriented such that when housing 23 is properly installed within receptacle 21, fastener holes 95 are sufficiently aligned with mounting holes 57 for receiving screw type fasteners through fastener holes 95 and into mounting holes 57. Fastener holes 95 are preferably countersunk holes. Housing 23 is preferably constructed of plastic but may alternatively be constructed of metal, wood, carbon fiber, a mixture of nylon and plastic, or any other suitable material or suitable combination of materials.

Figure 11:
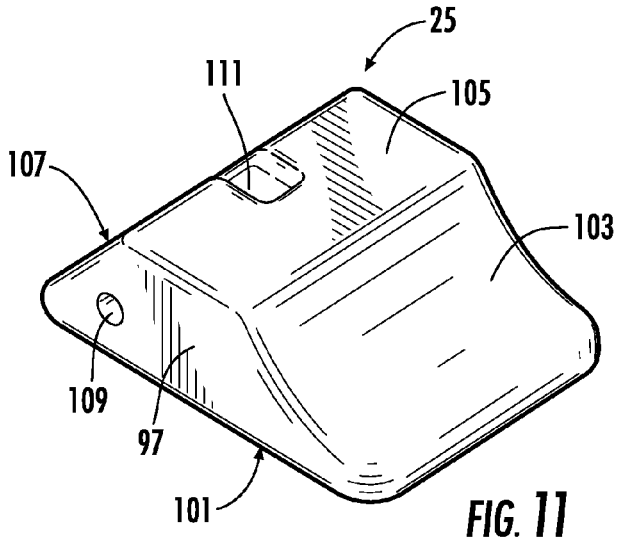
FIG. 11 is a perspective view of the hook of the aquatic recreational system of FIG. 1.
Figure 12:
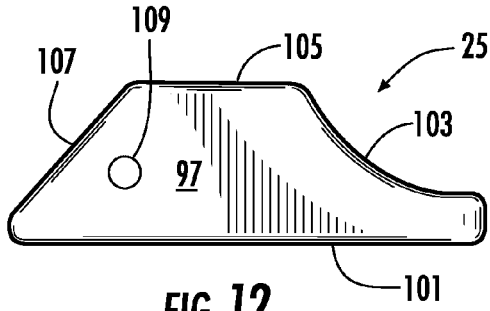
FIG. 12 is a side view of the hook of the aquatic recreational system of FIG. 1.
Figure 13:
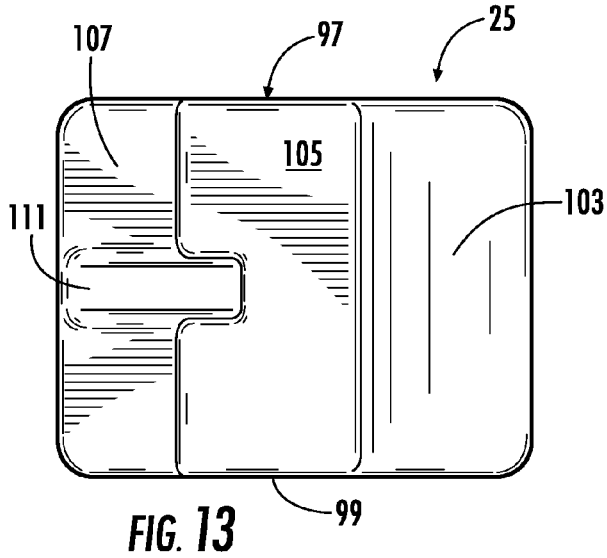
FIG. 13 is a bottom view of the hook of the aquatic recreational system of FIG. 1.

Referring now to FIGS. 11-13 in the drawings, perspective, side, and bottom views of hook 25 according to the present invention are illustrated, respectively. Hook 25 preferably comprises a right hook face 97, a left hook face 99, a hook top face 101, a curved face 103, a storage face 105, and an operational face 107. A hook rod hole 109 extends from right hook face 97 to left hook face 99. Hook rod hole 109 is adapted for receiving rod 27 therethrough. Hook top face 101 is preferably substantially parallel to riding surface 31 when hook 25 is in the second position where hook 25 is fully housed within housing 23. Curved face 103 is preferably a curved surface where the radius of curvature is adapted to accommodate conventional ski rope handles. Storage face 105 preferably significantly contacts floor 71 when hook 25 is in the second position where hook 25 is fully retracted into housing 23.

It should be understood that curved face 103 may include multiple curves of differing radii of curvature to accommodate various sizes of ski rope handles and ropes without handles. For example, curved face 103 may include a second, smaller curved face 104 (see FIG. 4) that would accommodate a rope, a small handle, or a handle with an upraised portion or ridge. In addition, hook 25 may include a longitudinal slot to accommodate a two-piece detachable handle having ropes extending from the middle of the handle. In other words, curved face 103 may be configured in a wide variety of shapes and sizes, and combinations of shapes and sizes, so as to allow use with a wide variety of ropes and handles, particularly specialized ropes and handles for particular water recreation activities.

Operational face 107 preferably contacts stop surfaces 91, thereby preventing further rotation of hook 25 away from the retracted position. A spring channel 111 is a recessed portion of hook 25 for receiving a portion of a typical helical coil type metal spring. Spring channel 111 is preferably located centrally between right hook face 97 and left hook face 99; however, spring channel may alternatively be located in any other suitable location on hook 25. The helically wound portion of a spring is preferably carried by rod 27 with rod 27 passing through the area between the windings of the spring. One arm of the typical spring is preferably contained by the walls of spring channel 111 while the remaining arm of the spring is preferably in contact with floor 71 such that the spring biases hook 25 to the retracted position.

Curved face 103 is preferably designed to effectively receive a rigid handle 127 (FIG. 1) of towline 17, as shown in FIGS. 1 through 4, or alternatively receive a flexible portion of towline 17.

Hook rod hole 109 is preferably aligned and oriented such that rod 27 may pass through hook rod hole 109 while also being received through rod holes 81 of housing 23. Hook rod hole 109 and rod holes 81 are preferably located and oriented such that when assembly 15 is properly assembled, hook 25 may rotate about rod 27 at least between the previously described fully protruding position and the previously described fully retracted position.

Hook 25 is preferably constructed of plastic but may alternatively be constructed of metal, wood, carbon fiber, a mixture of nylon and plastic, or any other suitable material or suitable combination of materials.

It should be appreciated that while a conventional spring has been described as the means for biasing hook 25, any other suitable biasing means may alternatively be incorporated. The spring is preferably constructed of metal, but may alternatively be constructed of plastic or any other suitable material or suitable combination of materials.

It should be appreciated that any sharp edges, corners, or interfaces of receptacle 21, housing 23, hook 25, or any other portion of aquatic recreation system 11 are preferably rounded, chamfered, filleted, or otherwise formed to reduce likelihood of injury to a rider.

In operation, the preferred embodiment of aquatic recreational system 11 may be utilized by a rider in the following manner. First, the rider lies prone atop riding surface 31. The rider then rotates hook 25 from a fully retracted position to a fully protruding position by pressing downward on the front portion of hook top face 101 and in front of the axis of rod 27. Next, the rider places handle portion 127 of towline 17 against curved face 107 and signals the tow vehicle or otherwise activates the tow vehicle to carefully remove slack from towline 17. Preferably after all slack is removed from towline 17, the rider may remove his hands from handle portion 127 and grasp kneeboard 13 as the tow vehicle accelerates and kneeboard 13 plows through water 19 or planes atop water 19.

Next, the rider may attempt to alter his body position from the prone position described above to a kneeling position on riding surface 31, such that his knees and shins are substantially located atop leg position feature 43. Next, the rider may grasp straps 45 and secure himself to kneeboard 13 by placing straps 45 over his thighs and interlocking the hook-and-loop features of straps 45. Once secured, the rider may grasp handle portion 127 of towline 17 and pull handle portion 127 away from curved face 107. As handle portion 127 is fully disengaged from hook 25, the spring acts against hook 25 to rotate hook 25 back to the fully retracted position.

The present invention provides significant advantages, including: (1) aiding young, weak, or inexperienced riders in achieving proper riding body positioning on an aquatic recreational device; (2) preventing unwanted interference between a towline and a tow hook; and (3) providing a tow hook that automatically retracts when not in use, thereby preventing injury to a rider.

While the present invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

The invention claimed is:

1. A kneeboard comprising:

a riding surface and a planning surface;

a knee strap for securing a rider;

a biasing means;

a hook having a retaining surface, the hook being biased by the biasing means, and the hook being rotatable relative to the riding surface; and a rod fixed relative to the riding surface, wherein the hook is rotatable about the rod relative to the riding surface, wherein a position of the retaining surface changes relative to the riding surface as the hook rotates relative to the riding surface; and wherein the hook is rotatable to an extended position extending upwardly from the riding surface, where the retaining surface is configured for retaining a towline.

2. The kneeboard according to claim 1, further comprising:

a housing connected to the hook.

3. The kneeboard according to claim 2, wherein the housing includes at least three fastener holes.

4. The kneeboard according to claim 1, wherein the riding surface comprises a molded leg position feature.

5. The kneeboard according to claim 1, wherein the biasing means comprises a spring.

6. The kneeboard according to claim 1, wherein the retaining surface of the hook includes a radius of curvature suitable for accommodating a ski rope handle.

7. A kneeboard comprising:

a riding surface and a planning surface;

a knee strap for securing a rider;

a biasing means; and a hook having a retaining surface, the hook being biased by the biasing means, and the hook being rotatable relative to the riding surface, wherein a position of the retaining surface changes relative to the riding surface as the hook rotates relative to the riding surface, wherein the hook is rotatable to an extended position extending upwardly from the riding surface, where the retaining surface is configured. for retaining a towline, and wherein the hook comprises a spring channel.

* * * * *